US011305901B2

(12) United States Patent
Sauerwein et al.

(10) Patent No.: US 11,305,901 B2
(45) Date of Patent: Apr. 19, 2022

(54) PACKAGING DEVICE AND PACKAGING PROCESS

(71) Applicant: AUTEFA SOLUTIONS GERMANY GMBH, Friedberg (DE)

(72) Inventors: Norbert Sauerwein, Augsburg (DE); Dirk Falise, Kaufering (DE); Rudolf Kuhn, Neusäß (DE)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 254 days.

(21) Appl. No.: 16/637,667

(22) PCT Filed: Aug. 7, 2018

(86) PCT No.: PCT/EP2018/071373
§ 371 (c)(1),
(2) Date: Feb. 7, 2020

(87) PCT Pub. No.: WO2019/030218
PCT Pub. Date: Feb. 14, 2019

(65) Prior Publication Data

US 2020/0255174 A1 Aug. 13, 2020

(30) Foreign Application Priority Data

Aug. 9, 2017 (DE) ..... 20 2017 104 766.0

(51) Int. Cl.
*B65B 27/12* (2006.01)
*B30B 9/30* (2006.01)
(Continued)

(52) U.S. Cl.
CPC ..... *B65B 27/125* (2013.01); *B30B 9/301* (2013.01); *B65B 9/026* (2013.01); *B65B 11/10* (2013.01); *B65B 11/58* (2013.01)

(58) Field of Classification Search
CPC ..... B65B 27/125; B65B 27/12; B65B 9/026; B65B 9/301; B65B 9/3003; B30B 11/10; B30B 11/58
See application file for complete search history.

(56) References Cited

U.S. PATENT DOCUMENTS 4,408,438 A * 10/1983 Rewitzer ..... B65B 27/125 53/438
4,738,078 A * 4/1988 Benz ..... B65B 11/10 53/439
(Continued)

FOREIGN PATENT DOCUMENTS

DE 4015642 A1 11/1991
DE 4015643 A1 11/1991
(Continued)

*Primary Examiner* — Andrew M Tecco
(74) *Attorney, Agent, or Firm* — McGlew and Tuttle, P.C.

(57) ABSTRACT

A controllable packaging device (5) and a method relate to packaging compressed bales (6) on a baling press (2) with a bale-fixing element (11) and a multi-component bale envelope (7) including an upper part (8), a lower part (9) and optionally a sheath-type side part (10). The packaging device includes a fixing device (23) applying the bale-fixing element (11), a supply device (25) supplying the upper part and the lower part and optionally an envelope device (24) applying the side part to the compressed bales. The fixing device and optionally the envelope device are arranged on a transport apparatus (19) that travels along the compressed bale in an advancing direction (22). The supply device is arranged on the transport apparatus and supplies the upper part and the lower part with a supply movement oriented transversely to the advancing direction, from the outside into the baling press.

20 Claims, 13 Drawing Sheets

(51) Int. Cl.

| | |
|---|---|
| ***B65B 9/02*** | (2006.01) |
| ***B65B 11/10*** | (2006.01) |
| ***B65B 11/58*** | (2006.01) |

(56) References Cited

U.S. PATENT DOCUMENTS

| | | | | | |
|---|---|---|---|---|---|
| 5,125,210 | A * | 6/1992 | Lang | B30B 9/3003 53/399 |
| 5,317,851 | A * | 6/1994 | Lang | B65B 27/125 53/176 |
| 5,369,935 | A * | 12/1994 | Lang | B65B 27/125 53/176 |
| 2017/0253384 | A1 * | 9/2017 | Pearson | B65B 5/045 |

FOREIGN PATENT DOCUMENTS

| | | | |
|---|---|---|---|
| DE | 69009648 | T2 | 11/1994 |
| DE | 4430537 | A1 | 1/1996 |
| EP | 0029977 | A1 | 6/1981 |
| EP | 0198992 | A1 | 10/1986 |
| EP | 0695690 | A1 | 2/1996 |
| WO | 8809748 | A1 | 12/1988 |

* cited by examiner

PACKAGING DEVICE AND PACKAGING PROCESS

CROSS REFERENCE TO RELATED APPLICATIONS

This application is a United States National Phase Application of International Application PCT/EP2018/071373, filed Aug. 7, 2018, and claims the benefit of priority under 35 U.S.C. § 119 of German Application 20 2017 104766.0, filed Aug. 9, 2017, the entire contents of which are incorporated herein by reference.

TECHNICAL FIELD

The present invention pertains to a packaging device for the packaging of pressed bales at a baling press by means of a bale-fixing element and a multipart bale wrapping that has an upper part and a lower part and a packaging process for the packaging of pressed bales at a baling press by means of a bale-fixing element and a multipart bale wrapping that has an upper part and a lower part.

TECHNICAL BACKGROUND

Such a packaging device is known from WO 88/009748 A1. It is used for packaging pressed bales at a baling press by means of a strap and a multipart bale wrapping that has an upper part, a lower part and a sheath-type side part. The controllable packaging device has a strapping device, a feed device for the upper part and the lower part as well as a loading and unloading device for the side part. The strapping device and the loading and unloading device are arranged together at a transport apparatus that can travel in a direction of feed along the pressed bale during the packaging process. The feed device is arranged separately therefrom on the side next to the baling press and it feeds the upper part and the lower part with an active feed motion from the outside into the baling press and at the press rams thereof. In another variant of this document, the upper part is carried along by the feed motion of a press box from a stationary coil in the path into the baling press and held on the box top side. A pivotable coil at the transport apparatus pivots over the lower press ram during the return movement thereof, wherein the bottom part is pulled over the lower press ram with clamp-type fixing in this direction.

Another packaging device with a modified loading and unloading device is known from DE 40 15 642 A1. The feeding of the upper part and the lower part of the bale wrapping will not be explained in more detail.

SUMMARY

An object of the present invention is to show an improved packaging technology.

The present invention accomplishes this object with the features described in the principal process claim and the principal device claim. The packaging technology claimed, i.e., the packaging device and the packaging process as well as the baling press and the baling press plant equipped therewith have various advantages.

A significant increase in capacity is achieved with the packaging technology claimed. More bales per hour can be packaged than with the prior-art technology.

The increase in capacity can be achieved by a rapid feeding of the upper part and the lower part of the bale wrapping. The feeding can take place during or immediately after the discharge of the just previously packaged pressed bale from the bale press.

This connection in time has the advantage that the process times for the bale discharge and for the feed can be overlapped. This leads to a shortening of the time required for packaging a pressed bale and to a corresponding increase in capacity of the packaging technology as well as the baling press equipped with it. The baling press can be prepared immediately for the next pressing and packaging operation by the packaging technology being claimed. The packaging device and especially its feed device can be correspondingly configured and controlled for this purpose.

The feed device which is carried along by the transport apparatus with the upper part and the lower part preferably already held ready for feeding can already be brought close to the feed position at the baling press during the application of the bale-fixing element and can be moved into the feed position and in front of the freely accessible pressed bale immediately after completion of the fixing process. A rapid and short movement of the transport apparatus in said direction of feed is sufficient for this purpose. The transport apparatus does not need first to be returned into its inoperative position as in the case of the state of the art.

It is advantageous, moreover, that the feed motion of the upper part and the lower part and the unloading of the bale can take place in the same direction and transversely to the direction of feed. The feed motion may have a straight alignment and only need a short feed path.

Both the upper part and the lower part of the bale wrapping can be fed by the feed device with the feed technology claimed. In this case, the upper part and the lower part can be fed simultaneously in a time-saving manner or offset in time.

The upper part and the lower part of the bale wrapping may be present as enveloping elements in the form of spread-out-flat, sheet-like and flexurally elastic enveloping elements, especially enveloping element blanks. The enveloping elements may consist of a suitable, preferably film-like material, e.g., a plastic. The material may be inert to the fibrous material of the pressed bale, as a result of which contaminations of the fibrous material can be avoided. To this end, it is also advantageous if the bale-fixing element, e.g., in the form of a bale strap with a plurality of metal strips, is applied on the outside on the bale wrapping previously applied to the pressed bale.

The enveloping elements can be kept ready in an alignment ready for feeding at the feed device, especially in a horizontally parallel alignment of its principal plane in relation to the principal plane of the respective associated press ram. They can be moved into the baling press from this position with a short and straight feed motion and possibly be transferred to enveloping element holders located there.

Furthermore, the packaging quality can be improved. The feeding of the upper part and of the lower part of the bale wrapping can take place with a defined and controllable feed motion. A precise positioning of the upper part and of the lower part in the baling press is hereby possible. The upper part and the lower part of the bale wrapping are preferably positioned and arranged at the press rams. This may occur in direct contact with or in the vicinity of the press rams. With the claimed feed technology, the upper part and the lower part can be fed into the baling press, especially at the press rams thereof, before the pressing of the pressed bale.

The bale wrapping covers and encloses the pressed bale preferably on all sides. As an alternative, a partial covering is possible, e.g., at the upper and lower areas of the bale. The bale wrapping can in this case fit tightly on the pressed bale and be held by the bale-fixing element.

The packaging technology claimed is suitable for a bale wrapping with said three parts. In another embodiment, it is also suitable for a two-part bale wrapping that has an upper part and a lower part, wherein a preferably sheath-type side part may be absent. The loading and unloading device is also dispensable for applying this side part at the press bale in case of such a configuration. The arrangement of the loading and unloading device at the transport apparatus is optional in this respect.

The side part of the bale wrapping preferably forms a closed sheath or a ring-shaped binder around the upright side surfaces of the pressed bale. The structural configuration of the loading and unloading device may vary. The loading and unloading device applies an enveloping element of the above-mentioned type by means of a stretched enveloping element curtain, which is moved along during the feed motion, or by means of an enclosing wrapping movement around the pressed bale and closes the enveloping element in a ring-shaped manner by means of a cutting and welding device, e.g., for forming the sheath-type side part. In this case, the enveloping element is also cut from an enveloping element reserve.

The feed device is preferably arranged in the direction of feed behind the fixing device and behind the loading and unloading device that may possibly be present. The loading and unloading device may in this case be located in the direction of feed in front of the fixing device. The feed device is arranged in the case of such a configuration in connection with the fixing device and in the direction of feed behind this fixing device. The arrangement of the feed device behind the fixing device may be formed at a spaced location and such that the fixing device and the possibly present loading and unloading device are spaced apart from the pressed bale in the feed position at the baling press. The feed device consequently has free and unhindered access to the pressed bale.

The packaging of the pressed bale with the bale wrapping and the bale-fixing element takes place within the baling press and preferably at the pressed bale held and clamped between the press rams. The pressing and completion of the pressed bale and its packaging may take place at the same location at the baling press or at different locations.

First the bale wrapping and then the bale-fixing element are preferably applied at the pressed bale in chronological sequence. Consequently, the bale-fixing element has preferably no direct contact with the pressed bale and the fibrous material thereof. Fixing of the pressed bale can take place in any desired and suitable manner. Configuration of the bale-fixing element as a strap and configuration of the fixing device as a strapping device are especially advantageous. The pressed bale may be fixed here with a plurality of parallel and spaced-apart, ring-shaped hoops made of metal or made of another correspondingly tension-proof material.

The bale wrapping upper part and lower part may be kept ready and be fed in the form of spread-out-flat, sheet-like and flexurally elastic enveloping elements. Such enveloping elements may especially be configured as enveloping element blanks.

The feed device may be structurally configured in a correspondingly suitable manner for keeping ready and feeding the upper part and lower part in the form of said spread-out enveloping elements, especially enveloping element blanks. It may also be controlled in the above-mentioned manner such that the feeding of the upper part and of the lower part takes place during the discharge of the just previously packaged pressed bale from the baling press. The feeding of the upper part and of the lower part may proceed simultaneously or offset in time one after the other.

The feed device preferably has for the upper part and the lower part feed elements that are arranged separated and spaced apart one above the other. This is advantageous for simultaneously keeping ready and feeding the upper part and the lower part. The feed operation can hereby be shortened in time and be accelerated. As an alternative, the feed device may have only one feed element, which keeps ready the upper part and the lower part and feeds them into the baling press one after another and in this case spaces them apart in height. The spaced-apart arrangement of the feed elements or the spacing in height to be covered by only one feed element can be coordinated with the opening position and spacing in height of the press rams.

The packaging device may have a manufacturing device to manufacture said enveloping elements, especially enveloping element blanks. The manufacturing device may be arranged separated from the feed device, and the manufacturing device completely manufactures said enveloping element or enveloping elements and then transfers same to the feed device. In a different configuration, the manufacturing device may be arranged at least partly at the feed device. The manufacture of the enveloping element may take place at least partly at the feed device in this case.

The manufacture of the enveloping elements may take place during the pressing and compaction of the pressed bale. The packaging device may in this case assume an inoperative position, which it can assume after the return movement from the feed position towards the direction of feed. The pressing and manufacturing times can consequently be overlapped in a time-saving manner. Moreover, the manufacture may be carried out during a downtime of the packaging device, and especially of its transport apparatus.

The manufacturing device has at least one ready position for an enveloping element reserve and at least one spreading device. The enveloping element reserve may be configured as a stack of prepared enveloping elements or preferably as a coil with a very long web of enveloping elements.

In one embodiment of the packaging technology, the ready position has a stationary arrangement, wherein the spreading device is arranged at the feed device and is also used for the transfer of the enveloping element to the baling press. The spreading device is arranged at each feed element in the preferred embodiment with a plurality of feeding elements.

In another embodiment, the ready position for the enveloping element reserve may be arranged at the feed device. In this case, the manufacturing device may be entirely arranged at the feed device. In the above-mentioned other configuration of a manufacturing device arranged in a separated manner, the spreading device is also arranged separated from the feed device. This may be a stationary arrangement. The feed device then has its own transfer device at the feed element or at the feed elements for the transfer of the enveloping element.

The packaging device may have one or more enveloping element holders for the temporary holding of the transferred enveloping element at the baling press. The enveloping element holders, one or more of which may be present, may temporarily hold the transferred enveloping element by means of a clamping connection or in a different manner and release same for pressing and/or folding over and applying to the pressed bale. The enveloping element holders may be arranged in a stationary manner or movable with the press ram or the press rams.

The packaging device may have a folding device, with which the upper part and the lower part are folded over and can be applied to the pressed bale. They then cover the top side and the bottom side of the pressed bale and an upper and lower partial area of the side surfaces of the bale. A possible side part may be applied in the form of a sheath web around the four upright side surfaces of the pressed bale and hereby brought to overlap with the laid-over areas of the upper part and the lower part.

The packaging device may have an unloading device for unloading the packaged pressed bale. This unloading device may be arranged at the transport apparatus. The unloading device may be configured in any desired and suitable manner, e.g., as a pivotable unloading fork. Due to the arrangement at the transport apparatus, the unloading operation may be overlapped in time with the feeding of the upper part and the lower part of the bale wrapping. It is, moreover, advantageous if the unloading device is positioned in the direction of feed behind the fixing device and is hereby arranged located opposite the feed device.

The transport apparatus may be configured in any desired and suitable manner. It may have a single-part or multipart configuration. In an advantageous embodiment, the transport apparatus has one or more, especially two, transport devices. These transport devices are arranged on one side or on both sides of the baling press and of the pressed bale. The plurality of, especially two, transport devices may travel in sync. They are moved in the direction of feed from the inoperative position into the feed position and in the opposite direction. In this case, they travel on one side or on both sides along the baling press and along the pressed bale. An opposite arrangement of the feed device and of the unloading device at different transport devices is also advantageous.

The claimed packaging technology is a technically and economically independent unit. It can be arranged at an existing baling press by retrofitting or retooling in exchange for a different packaging technology. As an alternative, the packaging technology may belong to the original equipment of a baling press.

A baling press that is suitable for the claimed packaging technology has a plurality of, especially two, press rams and a press drive. The press drive may generate a very high pressing force of several thousand kN, especially 3,000 kN to 5,000 kN, for bale compression. The pressed bale is advantageously clamped between press rams during the packaging in the above-mentioned manner.

The baling press technology, i.e., the baling press and the press process, are used for manufacturing highly compacted pressed bales made of a fibrous material. This material may be loosely cut staple fibers or fiber strands, the latter also being called tow. The fibrous material may consist of synthetic fibers or natural fibers or mixtures thereof.

The baling press may be configured in a different manner. It is preferably configured as a finishing press, to which prepressed fibrous material is fed from a separately arranged prepress for finishing pressing. The feeding may take place in the compacted bale form by means of a movable feed fork, which holds the prepressed bale in a clampingly closed manner and inserts same in the clamping form into the finishing press between the press rams standing by. As an alternative, a feeding of fibrous material in a different manner, e.g., in a press box is possible. The finishing pressing can take place freely or with lateral guiding of the fibrous material, e.g., in a press box, especially in a prepress box. The packaging device is arranged at the finishing press and packages the finish-pressed pressed bale.

In another embodiment, the feeding and prepressing of the fibrous material as well as the finishing pressing of the pressed bale may take place at the baling press.

A separate arrangement of the prepress and the finishing press has advantages in terms of capacity. Due to the greater time requirement of the prepress, a plurality of prepresses may be associated with a finishing press and be connected to a suitable conveying device, especially to said feed fork. The efficiency of the claimed packaging technology has an especially advantageous effect here. The total time required for the finishing pressing and packaging of the pressed bale can be minimized.

Consequently, even more prepresses can be associated with such a finishing press. Conversely, this means in case of a baling press plant with a plurality of prepresses that the number of finishing presses and packaging devices needed for this purpose can be significantly reduced. Consequently, the baling press plant claimed has a smaller volume and space requirement and a higher efficiency.

The present invention is shown in examples and schematically in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
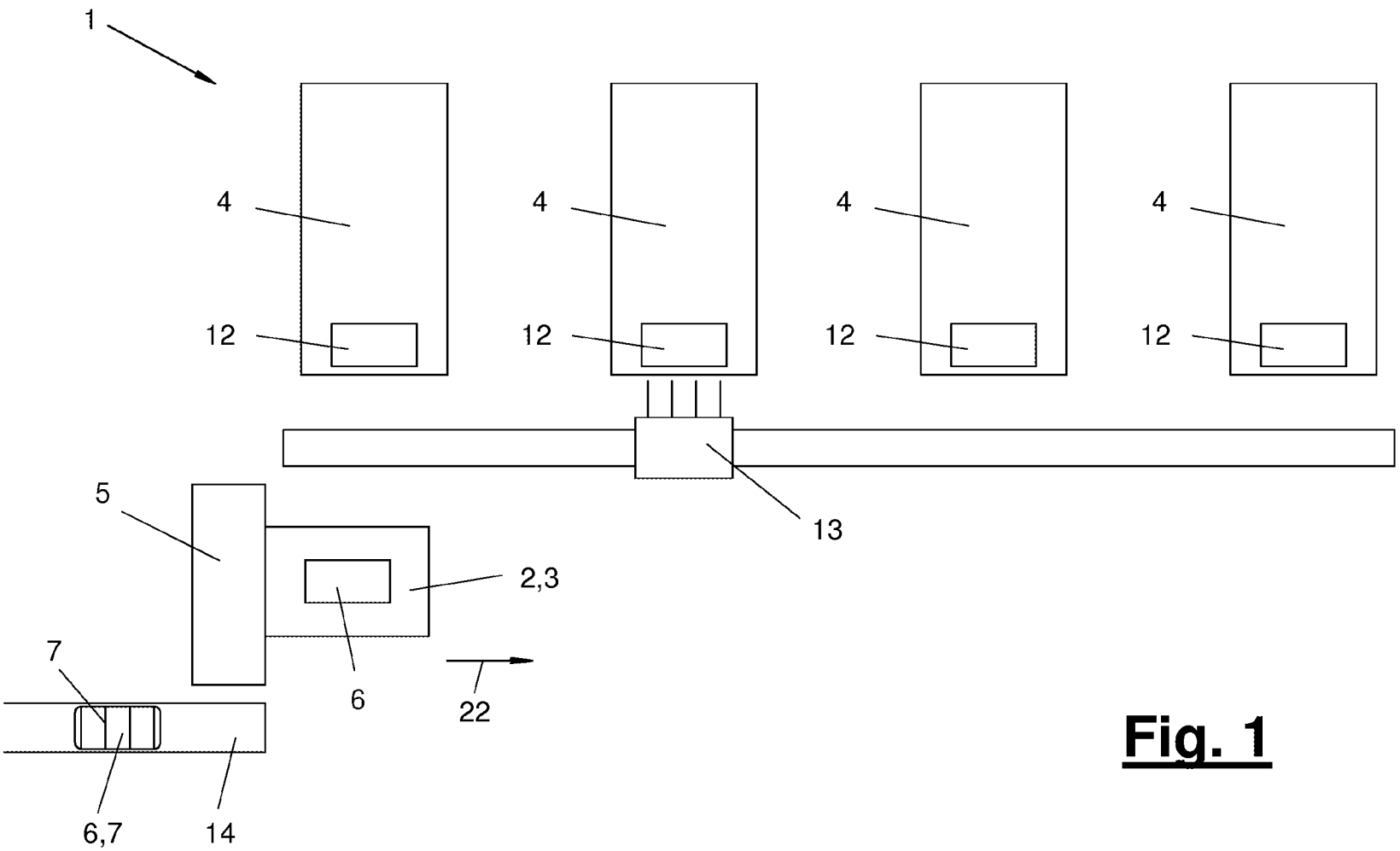
FIG. 1 is a schematic plan view of a baling press plant with a plurality of prepresses, a finishing press with a packaging device and a conveying device.

Referring to the drawings, the present invention pertains to a packaging device (5) as well as to a packaging process for highly compacted pressed bales (6). The present invention further pertains to a baling press (2) with such a packaging device (5) and to a baling press process. The present invention also includes a baling press plant (1) with a plurality of baling presses (2) and one or more packaging devices (5) in addition to the process.

Figure 12:
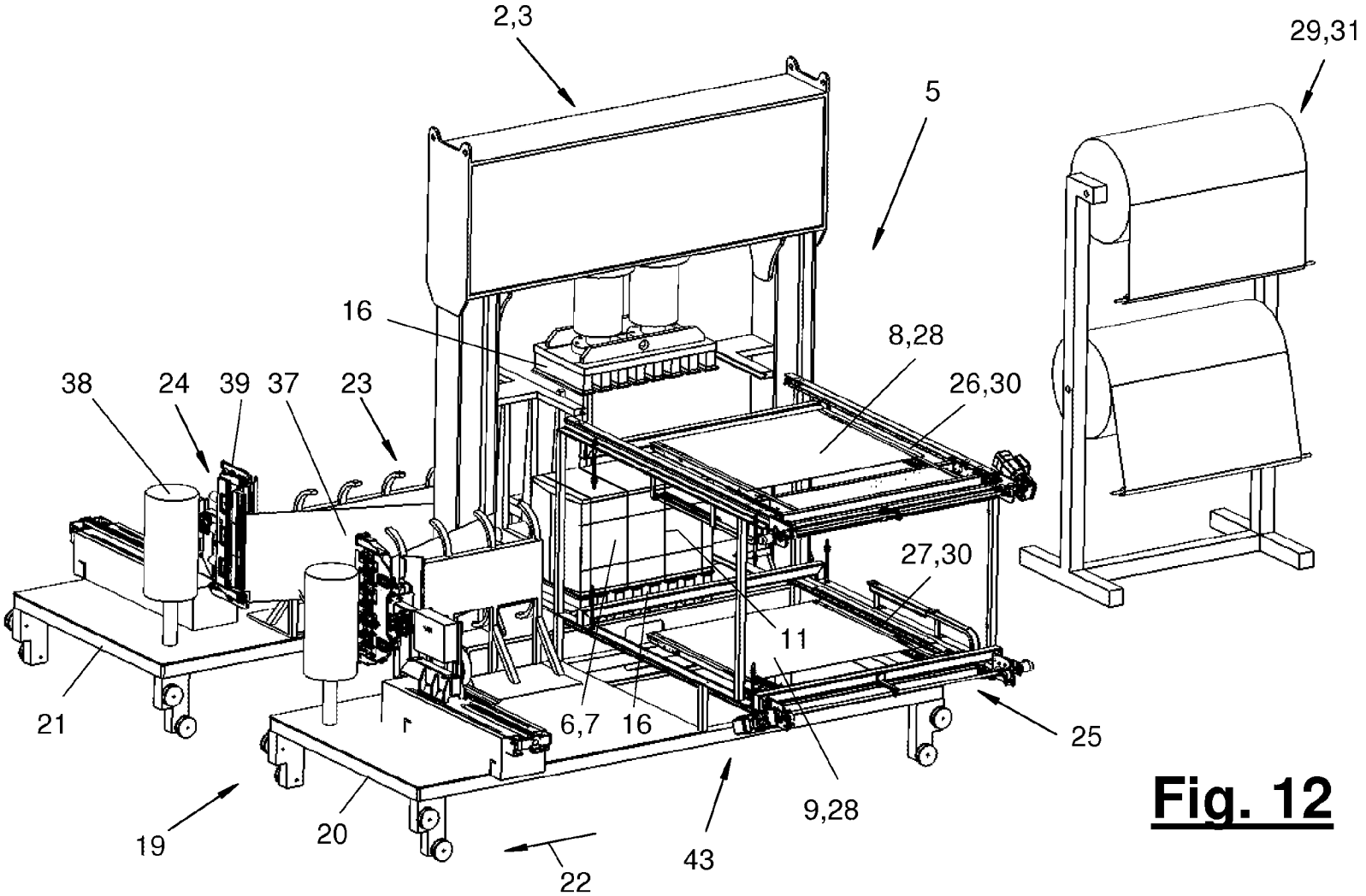
FIG. 12 is a perspective view showing another operating position of the baling press and the packaging device.

The pressed bale (6) consists of the fibrous material mentioned in the introduction and has a cubic shape. The bale is pressed into its final shape in the baling press (2) with the above-mentioned high pressing forces. It is subsequently provided with a multipart bale wrapping (7) and with a bale-fixing device. The finish-packaged pressed bale (6) is shown in FIG. 12. It is then unloaded from the baling press (2) by means of an unloading device (42).

Figure 2:
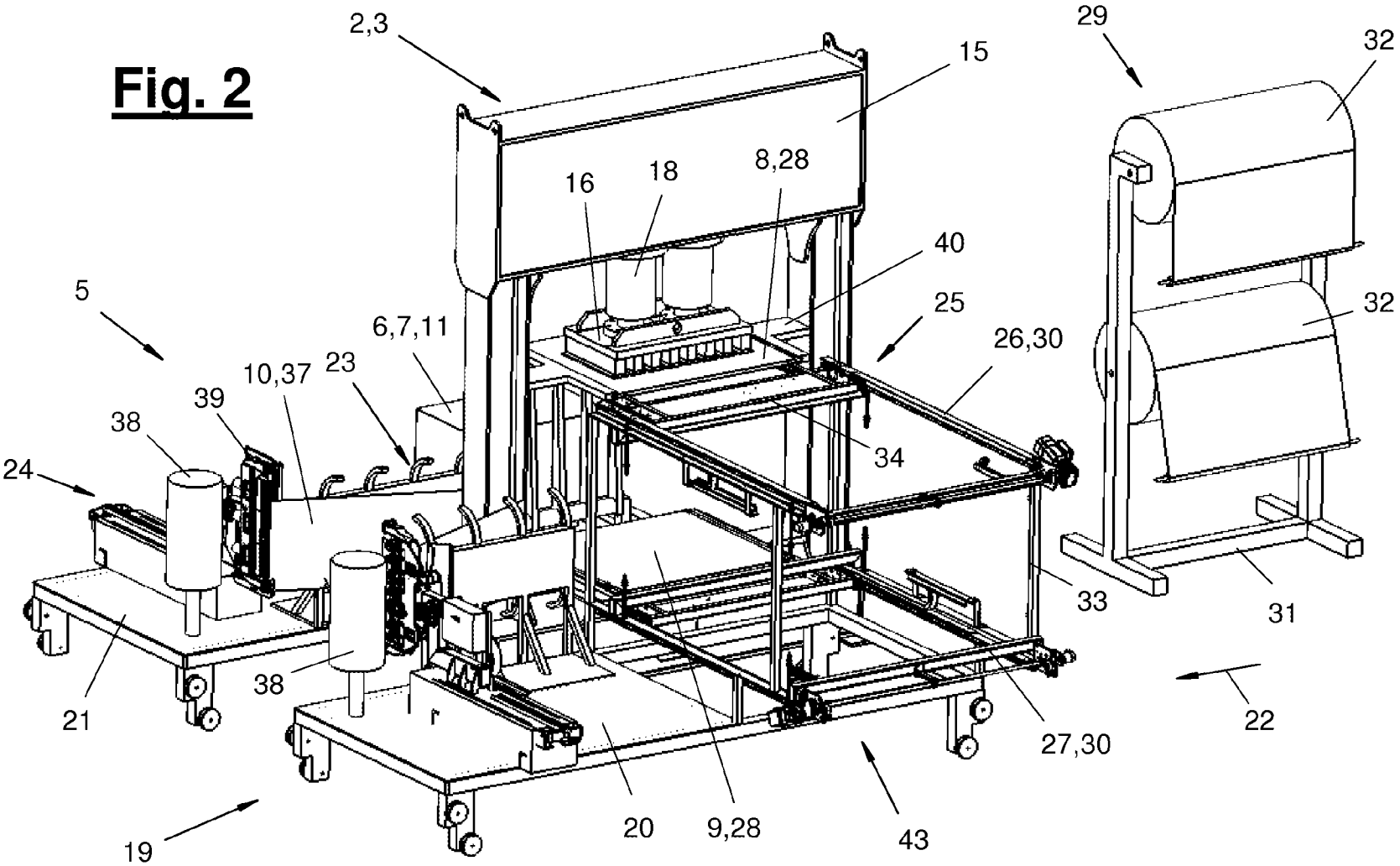
FIG. 2 is a perspective view of a baling press with the packaging device in a first operating position.
Figure 3:
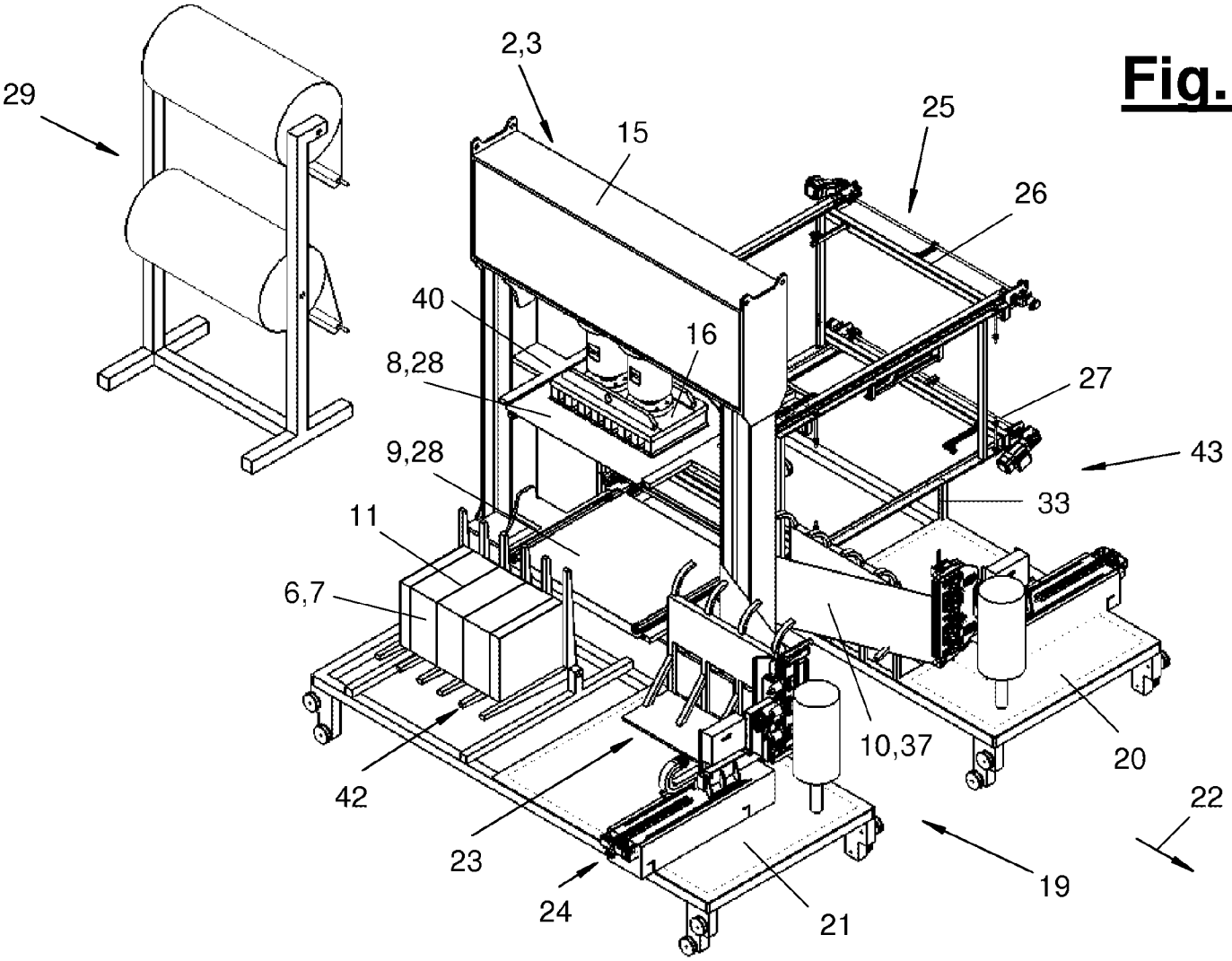
FIG. 3 is another perspective view of a baling press with the packaging device in a first operating position.

An upper part (8) and a lower part (9) of the bale wrapping (7) can be inserted into the baling press (2) before the pressing of the next pressed bale with a time overlap or immediately subsequent to the unloading. This is carried out by means of a feed device (25) of the packaging device (5). FIGS. 2 and 3 show this operating position. The pressing operation can then start and the further packaging process can proceed thereafter.

The pressed bale (6) is packaged in the baling press (2) and preferably at the location of its pressing in the embodiment shown. FIGS. 2 through 13 illustrate the operations proceeding in this case and operating positions.

The bale wrapping (7) has three parts and consists of said upper part (8) and said lower part (9) as well as a side part (10) in the exemplary embodiments shown. The upper part (8) and the lower part (9) cover the horizontal top side and the horizontal bottom side, respectively, of the pressed bale (6) as well as adjacent upright side wall areas. The side part (10) has a sheath-type configuration. It covers and encloses the upright side walls of the pressed bale (6) as well as the wrapped edge areas of the upper part (8) and the lower part (9) in a preferably closed ring shape.

The parts (8, 9, 10) of the bale wrapping (7) consist of the enveloping material mentioned in the introduction, especially of a plastic film. For example, polyethylene films, especially films made of HDPE, are suitable.

The baling press (2) has a press frame (15) with press rams (16, 17) arranged in it and with a press drive (18). Two press rams (16, 17) are preferably arranged spaced vertically one above the other, one or both of which may be moved with a press drive (18). In the embodiments shown, the press ram (17) is fixed to the frame and the upper press ram can be raised and lowered. The press rams (16, 17) have tying grooves on their contact surface with the fibrous material (12) and the pressed bale (6) for receiving a bale-fixing element (11), which in the embodiment as a strap being shown consists of a plurality of hoops, which are metallic, enclose the pressed bale (6) in a ring-shaped pattern and are tension-proof.

The baling press (2) is configured in the exemplary embodiments being shown as a finishing press (3), to which prepressed fibrous material (12) is fed from the outside for finishing pressing and for manufacturing the pressed bale (6). The pressed bale (6) is packaged with the packaging device (5) at the finishing press (3).

FIG. 1 schematically shows a baling press plant (1) with such a finishing press (3). A plurality of prepresses (4), in which the fibrous material (12) is prepressed, are associated with this baling press plant (1). The prepressed fibrous material (12) is fed with a conveying device (13) from the prepresses (4) to the finishing press (3).

The conveying device (13) may be configured in any desired and suitable manner. In the embodiment shown, it has a feed fork, which can travel along the lined-up prepresses (4) and the finishing press (3) which is located opposite them, which feed fork may, moreover, rotate about the vertical axis as needed. The feed fork may be moved suspended at a portal or standing and floor-mounted with a horizontal conveying vehicle that can travel along one or two axes. It has a variable opening width with fork arms that are movable in relation to one another and are driven in a controlled manner and that correspond to the tying grooves at the press rams of the prepresses and the finishing press (3, 4).

With the feed fork, the fibrous material (12) prepressed into the form of a bale can be removed at a prepress (4) while maintaining the prepress pressure and can be inserted into the finishing press (3), and the feed fork (13) can be removed again after applying the press rams (16, 17). The pressed bale can then be further compressed and be finish-pressed with the finishing press force, which is considerably higher than the prepressing force. The conveying device (13) shown with the feed fork, which is movable and can travel, may be configured corresponding to WO 2013/030401 A2. A suspended arrangement of the feed fork is advantageous in this case.

The packaging device (5) has a fixing device (23) for applying the bale-fixing element (11), a loading and unloading device (24) for applying the side part (10) of the bale wrapping (7) and a feed device (25) for feeding the upper part (8) and the lower part (9) of the bale wrapping (7) as well as a transport apparatus (19).

Said parts (8, 9, 10) of the bale wrapping (7) are formed by the enveloping elements (28, 37) which were mentioned in the introduction. The packaging device (5) has a manufacturing device (29) for the enveloping element (28) of the upper part (8) and the lower part (9). The packaging device (5) may further have one or more enveloping element holders (40), a folding device (41) for the upper part and the lower part (8, 9) and an unloading device (42) for the packaged pressed bale (6).

The fixing device (23), the loading and unloading device (24) and the feed device (25) are arranged at the transport apparatus (19). They are moved together along the baling press (2) and the pressed bale (6) located there by this transport apparatus (19) in a direction of feed (22) during the packaging process. In this case, the movement takes place from an inoperative position shown in FIGS. 4 and 5 into the feed position (43) shown in FIGS. 2, 3, 12 and 13. In the feed position (43), the upper part and the lower part (8, 9) are fed by the feed device (25) to the baling press (2) and to the press rams (16, 17) thereof.

As FIGS. 2 through 13 illustrate, the feed device (25) is arranged behind the fixing device (23) and the loading and unloading device (24) in the direction of feed (22). In this case, the fixing device (23) is located behind the loading and unloading device (24). During the feed motion in the direction (22), the loading and unloading device (24) is hence first moved from the inoperative position (44) to the pressed bale (6) and subsequently the fixing device (23) and finally the feed device (25) are moved. The unloading device (42) is also arranged behind the fixing device (23) in the direction of feed (22).

The fixing device (23) is configured as a strapping device in the exemplary embodiments shown. This fixing device (23) has strapping heads and deflecting guides, which are arranged on both sides of the pressed bale (6) and of the press rams (16, 17) as viewed in the direction of feed (22). The strapping heads send hoops through the tying grooves of the press rams (16, 17) and tighten as well as bind these after deflection and return have been carried out.

In the exemplary embodiments shown, the loading and unloading device (24) forms a curtain made of the enveloping element (37), which is stretched between two enveloping element reserves (38), which are arranged on both sides of the pressed bale (6) in the direction of feed (22), e.g., coils driven in a rotating and controllable manner. The enveloping element curtain is located within the frame opening of the press frame (15) and assumes an upright position. During the feed motion in the direction (22), the enveloping element curtain is first applied to the first upright side surface on the front side of the pressed bale (6) and wrapped around the pressed bale (6) and the adjacent upright side surfaces during the further feed motion in the U-shaped manner.

The loading and unloading device (24) has further a cutting and welding device with two cutting and welding units, which can travel transversely to the direction of feed (22) and which pick up the enveloping element (37) behind the pressed bale (6) and apply it to the other upright end face of the pressed bale (6). In this case, the enveloping element curtain is closed in a ring-shaped manner, cut from the enveloping element reserve and at the same time forms a new and closed enveloping element curtain. The loading and unloading device (24) may be configured, e.g., corresponding to WO 88/009748 A1.

The feed device (25) carries out a feed motion for feeding the upper part and the lower part (8, 9), which feed motion is directed transversely to the direction of feed (22) and is preferably straight. The feed device (25) keeps ready the upper part and the lower part (8, 9) in the form of spread-out-flat, sheet-like and flexurally elastic enveloping elements (28) and also feeds them to the baling press (2) in this form.

Figure 4:
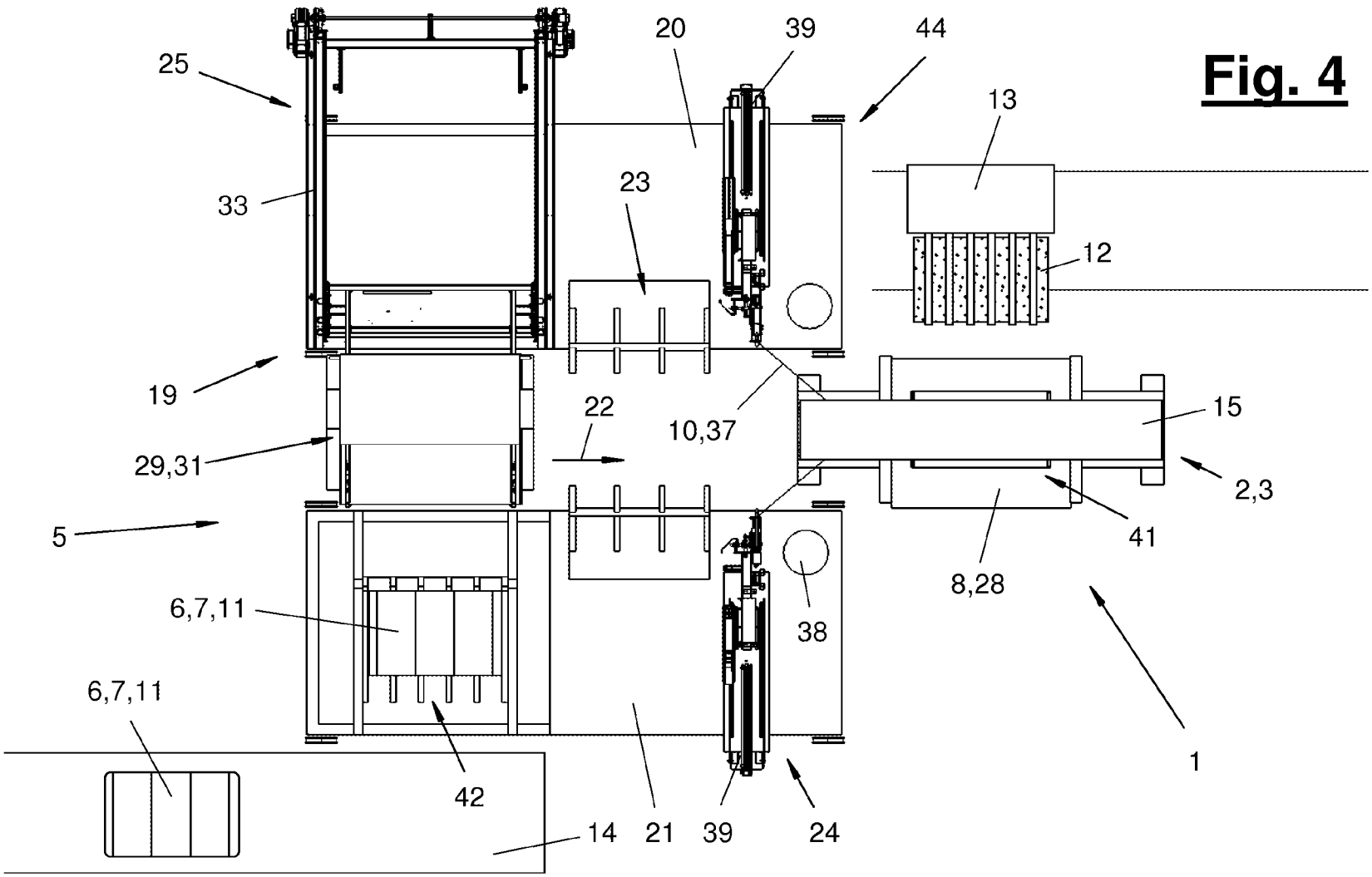
FIG. 4 is a top view of the baling press and the packaging device according to FIG. 2 in a different operating position.

The feed device (25) is arranged only on one side of the baling press (2) or of the pressed bale (6), as viewed in the direction of feed (22). The unloading device (42), which is preferably likewise arranged at the transport apparatus (19), is arranged on the opposite other side of the baling press (2) or of the pressed bale (6). As FIG. 4 illustrates, the feed device (25) and the unloading device (42) are arranged located opposite one another transversely to the direction of feed (22). In this case, the feed motion for the upper part and the lower part (8, 9) and the unloading movement for the finish-pressed and packaged pressed bale (6) have the same direction.

The feed device (25) has for the upper part (8) and the lower part (9) two feed elements (26, 27), which are arranged separated and spaced apart one above the other. The feed elements (26, 27) have a similar configuration. They may be arranged together at a cubic, frame-like platform (33) that is arranged on the transport apparatus (19). The feed elements (26, 27) have each a carriage (36) with a gripping device (35) and with a cutting device (36) for the enveloping element (28), which carriage (36) can travel transversely to the direction of feed (22) at the platform (33) and guides located there. The carriage (34) may have a carrying device, e.g., in the form of parallel carrying arms, which project transversely to the direction of feed (22) and on which the enveloping element (28) is applied and held in a spread-out-flat manner. The enveloping element (28) may be present in the form of an enveloping element blank, which is formed by means of the manufacturing device (29).

During the feed of the upper part and of the lower part (8, 9) and of the enveloping element (28), a transfer takes place at respective enveloping element holders (40) on both sides, which belong to the packaging device (5) and which are arranged in a stationary or movable manner, especially movable together with a press ram (16, 17), at the baling press (2). The enveloping element holders (40) in pairs may each have a strip-like clamping device for the enveloping element edge, both of which are aligned transversely to the direction of feed (22). By means of the enveloping element holders (40), the upper part (8) can be arranged and positioned at or close to the upper press ram (16) and the lower part (8) can be arranged and positioned at or close to the lower press ram (17).

In terms of their area, the enveloping elements (28) or the enveloping element blanks in question are larger than the upper side or bottom side of the pressed bale (6), wherein the overhang that extends and is present on all sides is folded over with the folding device (41) after pressing and is applied to the respective adjacent, upright side wall areas of the pressed bale (6).

The folding device (41) is not shown in the drawings. It may be configured in any desired and suitable manner. It may be formed, e.g., by a folding frame or by folding fingers, which are arranged at the baling press (2) in a suitable manner, e.g., at the press rams (16, 17). The folding device (41) may be configured, e.g., according to DE 40 15 642 A1.

The manufacturing device (29) is used for manufacturing spread-out-flat, sheet-like and flexurally elastic enveloping elements (28), especially enveloping element blanks. The manufacturing device (29) is at least partly arranged at the feed device (25) in the exemplary embodiments shown.

The manufacturing device (29) has at least one ready position (31) for an enveloping element reserve (32), especially for a coil as well as at least one spreading device (30) for the enveloping element (28). In the exemplary embodiments shown, two enveloping element reserves (32) or coils are present for the upper part and the lower part (8, 9) and are arranged spaced apart one above the other as well as in a stationary manner with the ready position (31).

A spreading device (30) each is arranged at a feed element (26, 27). The spreading device (30) may also be used for the transfer or feeding of the enveloping element (28) to the baling press (2). The carriage (34), the gripping device (35) and the cutting device (36) may be common components of the spreading device (30) and of the respective feed element (26, 27).

During the manufacture of the enveloping element (28) and of the enveloping element blank, the feed device (25) is positioned in front of the enveloping element reserves (32), as viewed in the inoperative position (44) transversely to the direction of feed (22). The lower edge of the enveloping element reserve (32), which extends in the direction of feed (22), is guided around a deflection roller, which is arranged in a stationary and rotatable manner. It assumes a defined position, in which it can be gripped by the gripping device (35) moved forward with the carriage (34), removed from the enveloping element reserve (32) and applied to the carrying device. During the backwards movement of the carriage (34), the enveloping element is held in the spread-out form and is guided on the edge at the gripping device (35) and/or at the platform (33), and the enveloping element assumes a planar and flat, especially horizontally arranged position.

The enveloping element blank is cut from the enveloping element reserve (38) by means of the cutting device (36) upon reaching the predefined length. The edge of the enveloping element reserve (38) can now be brought into the defined position. The cut front edge and/or the side edges of the enveloping element blank, which side edges are aligned transversely to the direction (22), can be gripped with an element of the gripping device (35) and moved towards the baling press (2) and the enveloping element holders (40) during the later feed.

FIGS. 5 through 8 show this manufacturing process. The manufacture and the preparation or the keeping ready of the enveloping element (28) suitable for feeding at the feed device (25) can take place during the pressed bale preparation and in the withdrawn inoperative position (44) of the packaging device (5).

The unloading device (42) is configured as a pivotable, angular unloading fork that can rotate about a tilt axis aligned along the direction of feed (22) in the exemplary embodiments shown. The fork arms can grip into said tying grooves and can lift out the packaged pressed bale (6) with a tilting movement when the press rams (16, 17) are opened. In this connection, the pressed bale (6) comes to lie on the other fork arms bent at an angle of preferably 90°.

The pressed bale (6) unloaded from the baling press (2) can be transferred to a discharge device (14) for the further transport. This can take place immediately or with a time delay, e.g., only in the inoperative position (44). The discharge device (14) may be configured and arranged in any desired suitable manner. It is arranged, e.g., in a stationary manner and is configured as a belt conveyor or roller conveyor.

The transport apparatus (19) may be configured and operate in a different manner. In the exemplary embodiments shown, it has a multipart configuration and comprises a plurality of, especially two, transport devices (20, 21) which are arranged on both sides of the baling press (2) and of the pressed bale (6), as viewed in the direction of feed (22). The ready position (31) with the enveloping element reserves (32) may also be located between the transport devices (20, 21) which are spaced apart laterally.

The transport apparatus (19) may be supported and guided in a floor-mounted or suspended manner. In the exemplary embodiments shown, the two transport devices (20, 21) are mounted and guided in the direction of feed (22) with rollers at a bottom-side guide device, e.g., a rail guide (not shown). As an alternative, a suspended mounting and guiding at columns or at a portal is possible. The plurality of, especially two, transport devices (20, 21) can be moved, especially can travel in and against the direction of feed (22). The transport apparatus (19) has for this a corresponding controllable drive.

The feed device (25) and a part of the fixing device (23) and of the loading and unloading device (24) each are arranged on the one transport device (20). The unloading device (44) and the other parts of the fixing device (23) and of the loading and unloading device (24) are arranged on the other transport device (21).

FIGS. 2 through 13 illustrate the packaging process in a plurality of steps.

The packaging device (5) is controlled and the packaging process proceeds such that the feeding of the upper part (8) and of the lower part (9) of the bale wrapping (7) takes place during the discharge of the just previously packaged pressed bale (6) from the baling press (2). The feeding may also take place in direct connection with said discharge or unloading. The upper part and the lower part (8, 9) are fed into the baling press (2), especially at the press rams (16, 17) thereof, before pressing of the pressed bale (6). In this case, the compression of the fibrous material (12) takes place with the upper part (8) or the lower part (9) applied to the respective press ram (16, 17).

FIGS. 2 and 3 show an initial operating position, in which the upper part (8) and the lower part (9) are fed straight into the baling press (2) and the enveloping element holder (40). The previously packaged pressed bale (6) is located on the unloading device (42). The packaging device (5) and the transport apparatus (19) thereof are located in the feed position (43).

Figure 5:
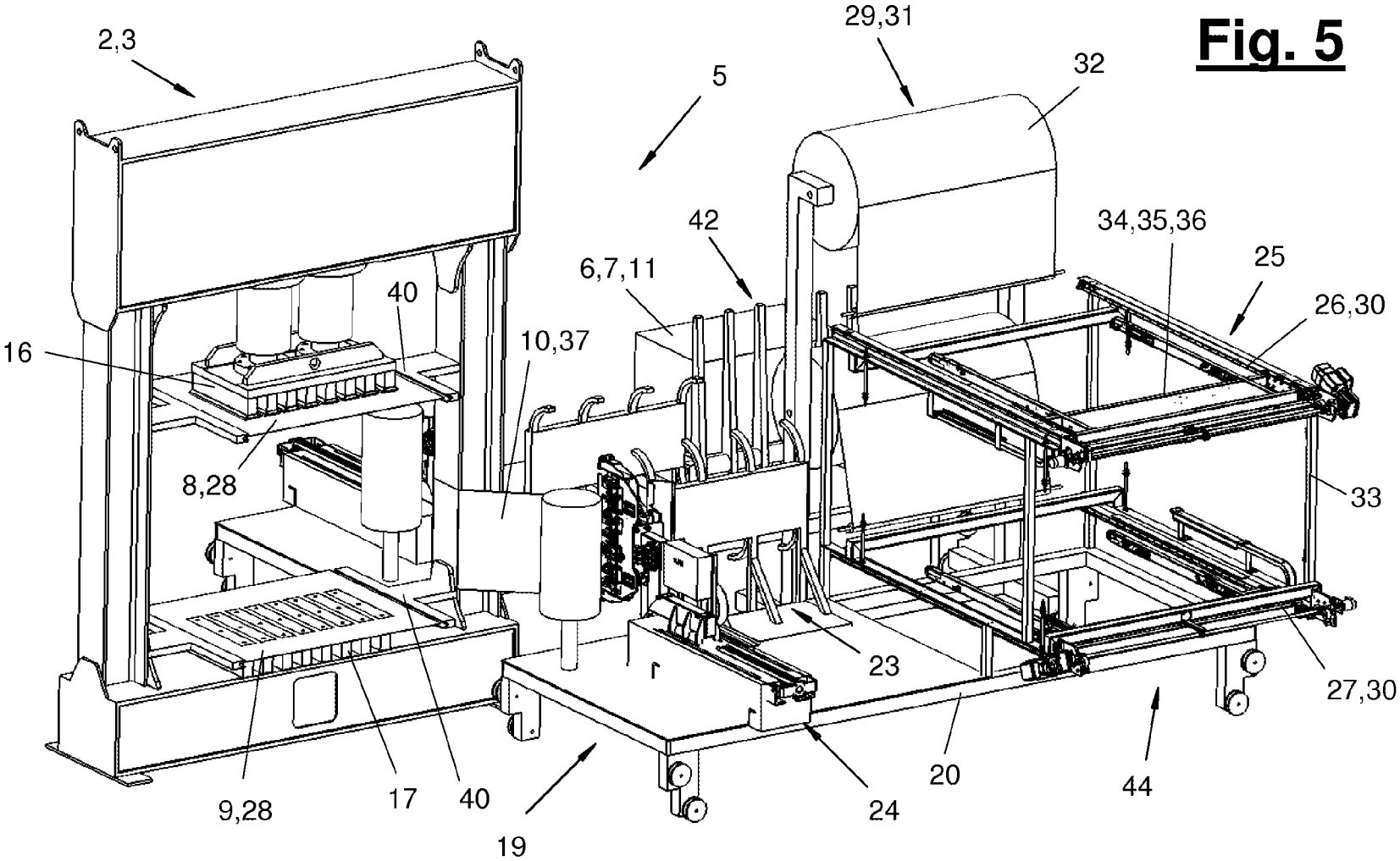
FIG. 5 is a perspective view of the baling press and the packaging device according to FIG. 2 in the different operating position.

The transport apparatus (19) is then moved towards the feed direction (22) in the inoperative position (44) shown in FIGS. 4 and 5. In this case, the pressed bale (6) loaded on the unloading device (42) is carried along. The newly formed enveloping element curtain (37) is likewise moved along. It can now be applied on the inner side of the rear press frame column and brought into a V-like clamping position according to FIG. 4. The baling press is now ready for the feeding of the fibrous material (12).

Figure 6:
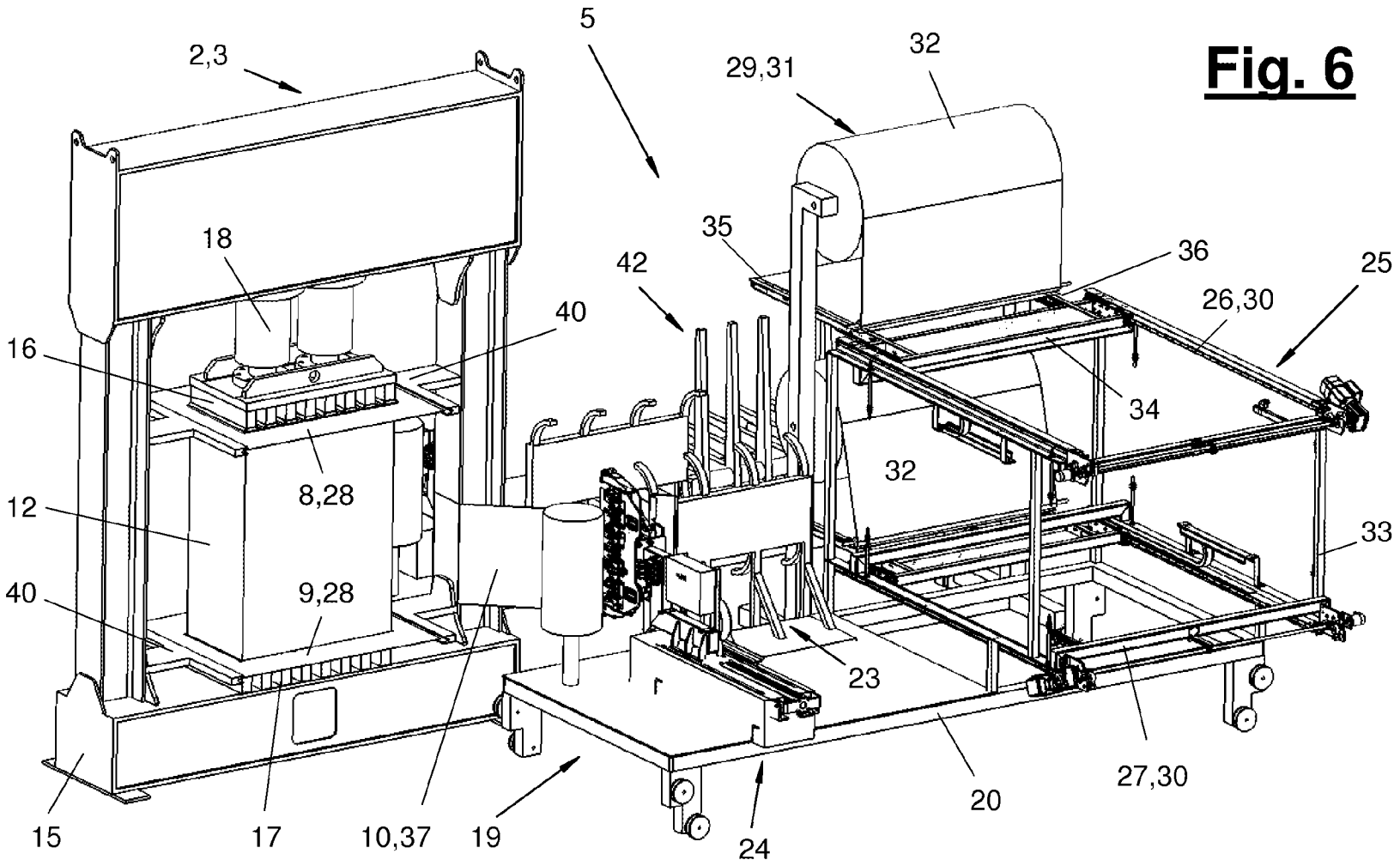
FIG. 6 is a perspective view showing another operating position of the baling press and the packaging device.

FIG. 6 shows an operating position, in which the conveying device (13) has inserted the bale-type and prepressed fibrous material (12) into the baling press (2) in the above-mentioned manner, and it is received and clamped between the press rams (16, 17) as well as the fed upper part and lower part (8, 9).

Figure 7:
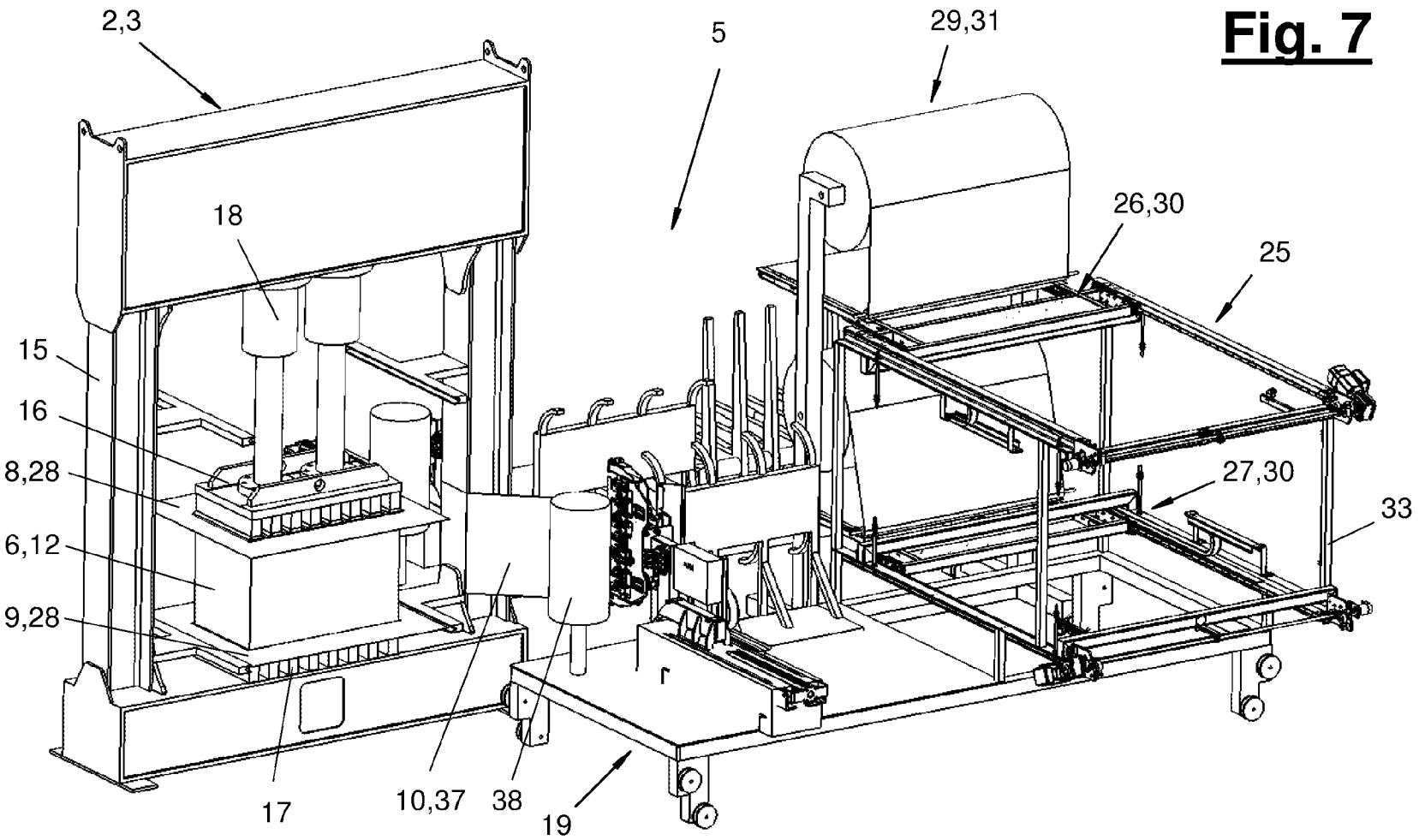
FIG. 7 is a perspective view showing another operating position of the baling press and the packaging device.

The fibrous material (12) is subsequently compressed, wherein the highly compacted pressed bale (6) is formed. FIG. 7 shows this operating position.

Figure 8:
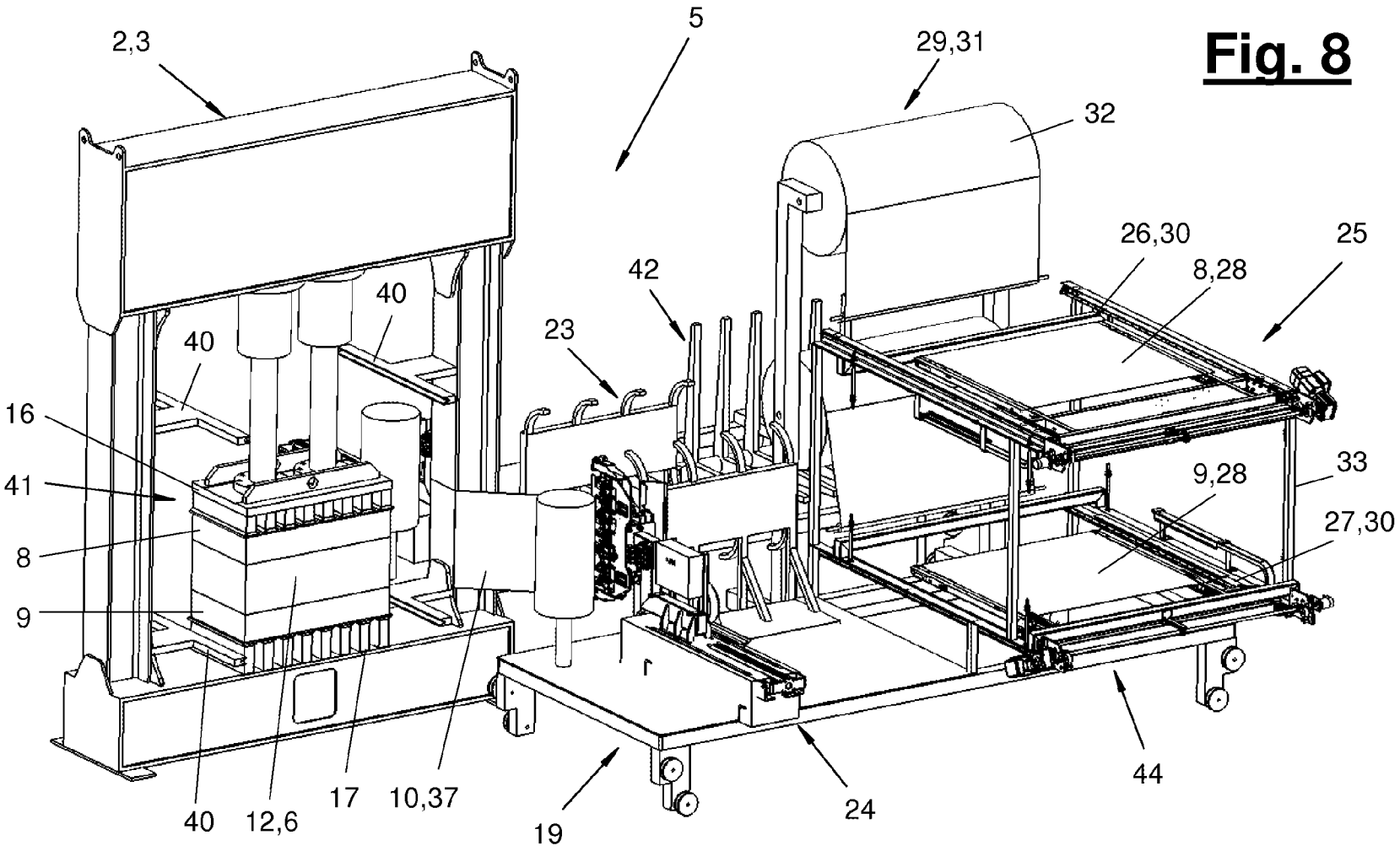
FIG. 8 is a perspective view showing another operating position of the baling press and the packaging device.
Figure 9:
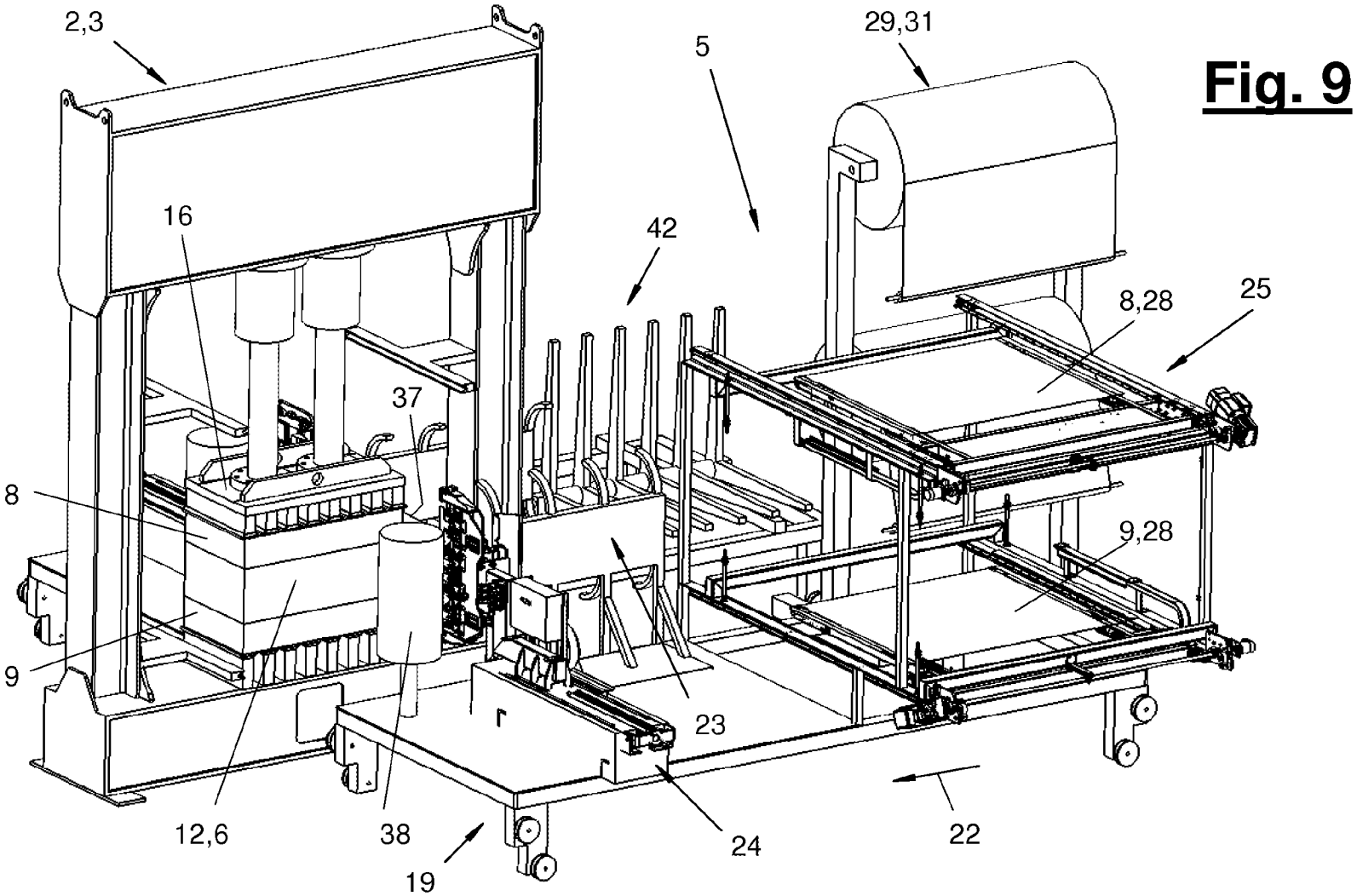
FIG. 9 is a perspective view showing another operating position of the baling press and the packaging device.
Figure 10:
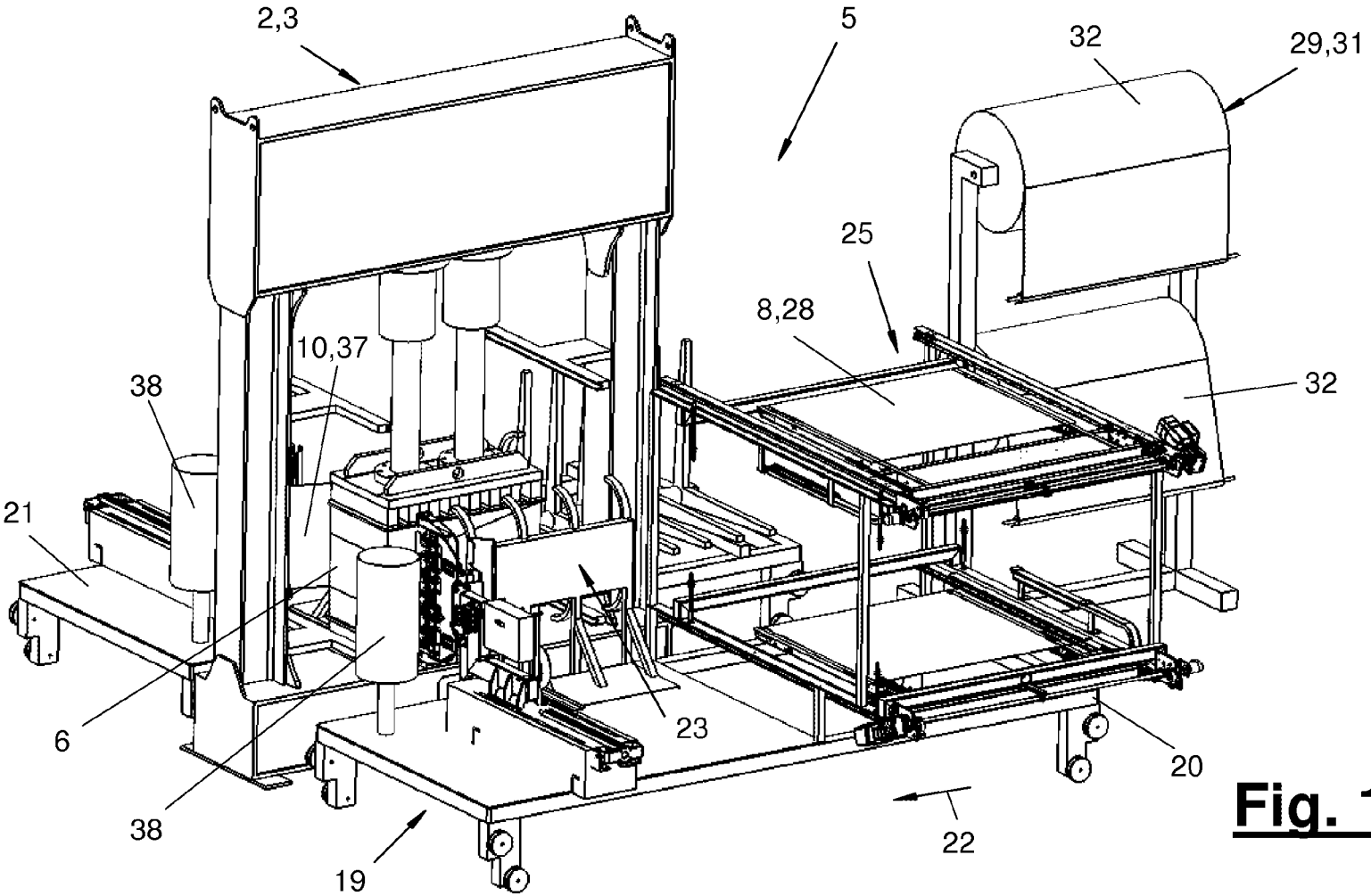
FIG. 10 is a perspective view showing another operating position of the baling press and the packaging device.

The folding device (41) can subsequently fold over the edge-side overhangs of the upper part and of the lower part (8, 9) downwards or upwards and apply same to the side walls of the pressed bale (6). FIG. 8 shows this operating position.

In the inoperative position (44), according to FIGS. 5, 6 and 7, the spreading device (30) with the carriage (34) and with the gripping device (35) moves out transversely to the direction (22) and below the enveloping element reserve (32), wherein the lower edge thereof is gripped and carried along and the enveloping element (28) is pulled off. On the return path according to FIG. 8, the enveloping element (28) is pulled onto the platform (33) and held in the spread position, e.g., by the gripping device (35).

The application of the sheath-type side part (10) or binder then starts. The transport apparatus (19) can in this case travel in the feed direction (22) according to FIG. 9. The enveloping element curtain (37) is now applied to the pressed bale (6) in the above-mentioned manner and placed in a U-shaped manner around the pressed bale (6) over the further travel path according to FIG. 10.

The application of the bale-fixing device (11) may take place during this laying-over movement or at the end of this laying-over movement.

Figure 11:
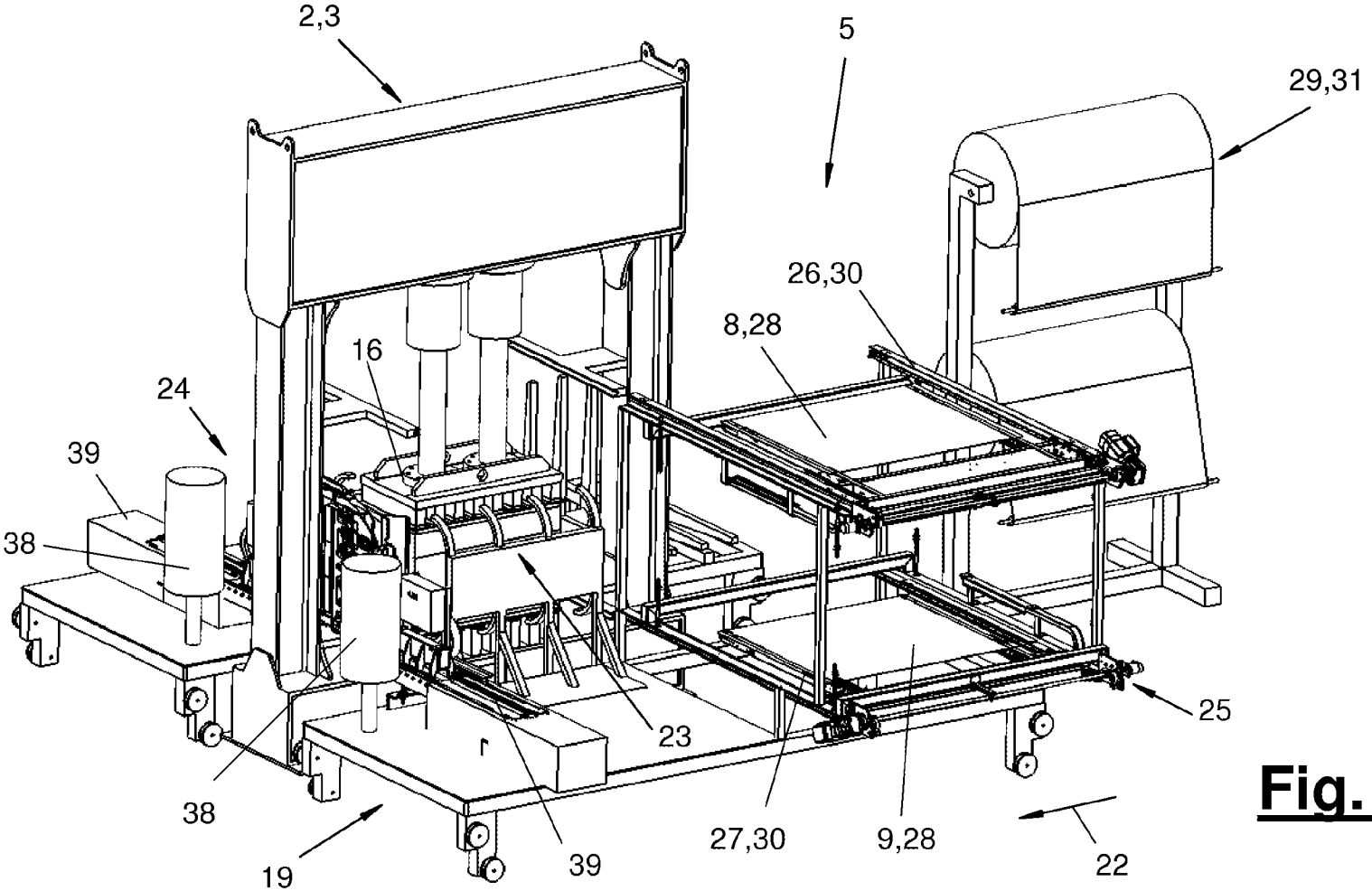
FIG. 11 is a perspective view showing another operating position of the baling press and the packaging device.

FIG. 11 shows an operating position, in which the fixing device (23) applies the bale-fixing device (11), especially a strap. In this position, the cutting and welding device (39) of the loading and unloading device (24) is also operating, closing the ring-shaped binder in the above-described manner, cutting it from the enveloping element reserve and at the same time forming a newly closed enveloping element curtain (37).

Figure 13:
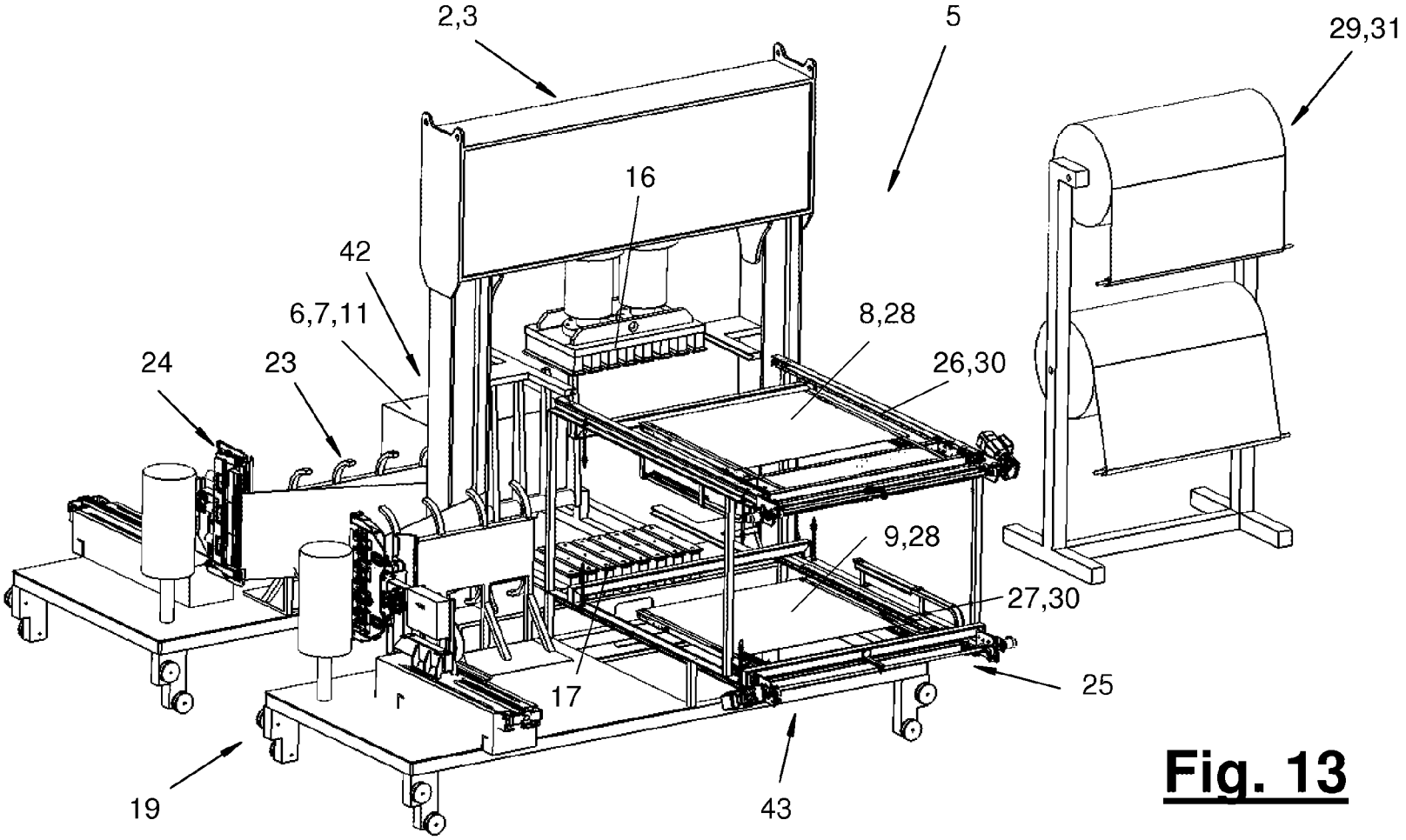
FIG. 13 is a perspective view showing another operating position of the baling press and the packaging device.

The transport apparatus (13) is subsequently moved a little bit further in the direction of feed (22) and then it assumes the feed position (43) shown in FIG. 12. The feed device (25) is arranged in the direction of feed (22) spaced apart behind the fixing device (23) such that in the feed position (43) the fixing device (23) and the loading and unloading device (24) are spaced apart from the pressed bale (6) and access is free to the pressed bale (6) for the feeding of the upper part and the lower part (8, 9). The newly formed enveloping element curtain (37) may in this case be clamped around the other press column in a U-shaped manner. The unloading device (42) is likewise arranged behind the fixing device (23) in the direction of feed (22) and on assuming the feed position (43) is located in a position suitable for unloading. FIG. 13 shows an operating position (13), in which the previously packaged pressed bale (6) is unloaded from the baling press (2), wherein the upper part and the lower part can be fed to the now exposed press rams (16, 17). These press rams (16, 17) were previously spaced apart from one another for the purpose of unloading.

The pressing and packaging cycle for the next pressed bale then begins from the beginning with the feeding of the upper part and the lower part (8, 9) and with the assumption of the operating position according to FIGS. 2 and 3.

Different variants of the exemplary embodiments shown and described are possible. In this case, the features of the exemplary embodiments and of the variants can be combined with one another and possibly also transposed as desired.

The loading and unloading device (24) may be configured in a different manner and it may pull off the enveloping element (37) from a single enveloping element reserve (38) and place it around the pressed bale (6) in an arcing and wrapping movement as well as subsequently bring the enveloping element or the binder into a ring shape with the cutting and welding device (39), close and cut same from the enveloping element reserve. Such a loading and unloading device (24) may be configured, e.g., according to DE 40 15 643 A1.

The loading and unloading device (24) may also be dispensed with in another variant. In this case, a two-part bale wrapping (7) may be formed, which is formed only from the upper part and lower part (8, 9), wherein these parts may overlap one another at the upright side walls.

The feed device (25) may be modified. In this case, it may have, e.g., only one feed element (26), which receives both enveloping elements (28) as well as is guided in a height-adjustable manner at the platform (33) and which feeds the upper part and the lower part (8, 9) to the baling press (2) in a manner offset in time and one after the other.

The manufacturing device (29) may also be modified. It may be entirely arranged at the feed device (25) in one embodiment, wherein, e.g., at the platform (33), the enveloping element reserves (32) are also arranged at the feed device (25), especially at the platform (33) thereof. In another embodiment, the manufacturing device (29) may be arranged entirely separated from the feed device (25). Here, the spreading device (30) is also arranged separated from the feed device (25). Said arrangement may be stationary.

Variants with regard to the baling press configuration are also possible. The baling press (2) may be configured as a combined prepress and finishing press, wherein the prepressing and finishing pressing take place immediately one after the other at the same position and, e.g., in a press box. For the packaging, the press box may subsequently be raised and access to the pressed bale (6) can be released.

In case of a separation into a prepress and a finishing press, both may be arranged together at a press frame. A configuration, e.g., in the form of a rotary press is possible here.

Further, it is possible that the press operation and the packaging of the pressed bale take place at different locations of the baling press. Such an embodiment may be configured, e.g., as a different type of rotary press corresponding to EP 0 695 690 A1.

While specific embodiments of the invention have been shown and described in detail to illustrate the application of the principles of the invention, it will be understood that the invention may be embodied otherwise without departing from such principles.

The invention claimed is:

1. A controllable packaging device for the packaging of pressed bales at a baling press with the pressed bales having a bale-fixing element and a multipart bale wrapping that has an upper part, and a lower part, the controllable packaging device comprising:

a fixing device for applying the bale-fixing element;

a feed device for feeding the upper part and the lower part; and a transport apparatus for travel in a direction of feed along the pressed bale, wherein the fixing device is arranged at the transport apparatus which can travel in a direction of feed along the pressed bale, and wherein the feed device feeds the upper part and the lower part with a feed motion aligned transversely to the direction of feed from the outside into the baling press and the feed device is arranged at the transport apparatus.

2. A packaging device in accordance with claim 1, wherein the feed device is arranged behind the fixing device in the direction of feed.

3. A packaging device in accordance with claim 1, wherein the feed device is arranged in a direction of feed at a spaced location behind the fixing device such that the fixing device is spaced apart from the pressed bale at the baling press in a feed position.

4. A packaging device in accordance with claim 1, wherein:

the feed device keeps ready and feeds the upper part and the lower part in the form of spread-out-flat, sheet and flexurally elastic enveloping elements the feed device has feed elements for the upper part and the lower part, which feed elements are arranged separated and spaced apart one above the other; and the feed device is controlled such that the feeding of the upper part and of the lower part is carried out during a discharge of a just previously packaged pressed bale from the baling press.

5. A packaging device in accordance with claim 1, further comprising a manufacturing device for manufacturing spread-out-flat, sheet and flexurally elastic enveloping element blanks, wherein the manufacturing device is arranged separated from the feed device or at least partly at the feed device.

6. A packaging device in accordance with claim 5, wherein:

the feed device has feed elements for the upper part and the lower part, which feed elements are arranged separated and spaced apart one above the other; and the manufacturing device has at least one ready position for an enveloping element reserve, and at least one spreading device arranged at each feed element and configured to transfer the enveloping element the enveloping element blanks to the baling press.

7. A packaging device in accordance with claim 1, wherein the packaging device has an unloading device arranged at the transport apparatus for the packaged pressed bale.

8. A packaging device in accordance with claim 7, wherein the unloading device is positioned in the direction of feed behind the fixing device and arranged located opposite the feed device.

9. A packaging device in accordance with claim 1, further comprising a wrapping device, wherein:

the multipart bale wrapping further comprises a sheath side part;

the wrapping device applies the side part at the pressed bale; and the wrapping device is arranged at the transport apparatus.

10. A packaging device in accordance with claim 9 wherein:

the feed device is arranged behind the wrapping device in the direction of feed;

the wrapping device is spaced apart from the pressed bale at the baling press in a feed position.

11. A bailing press and packaging device combination comprising:

a baling press providing pressed bails; and a controllable packaging device for the packaging of the pressed bales, the packaging device comprising:

a fixing device for applying a bale-fixing element;

a feed device for feeding an upper part and a lower part of a multipart bale wrapping; and a transport apparatus which travels in a direction of feed along the pressed bale, wherein the fixing device is arranged at the transport apparatus, and wherein the feed device feeds the upper part and the lower part with a feed motion aligned transversely to the direction of feed from the outside into the baling press and the feed device is arranged at the transport apparatus.

12. A bailing press and packaging device combination in accordance with claim 11, wherein:

the baling press comprises a plurality of press rams and a press drive; and the pressed bale is clamped between the press rams during packaging by the packaging device.

13. A bailing press and packaging device combination in accordance with claim 11, wherein the baling press is configured as a finishing press for prepressed fibrous material.

14. A baling press and packaging device combination in accordance with claim 11, further comprising a wrapping device, wherein:

the multipart bale wrapping further comprises a sheath side part;

the wrapping device applies the side part at the pressed bale; and the wrapping device is arranged at the transport apparatus.

15. A process for packaging pressed bales at a baling press, the process comprising the steps of:

applying a bale-fixing element by a fixing device; and feeding an upper part and a lower part of a multipart bale wrapping to apply the upper part and the lower part at the pressed bale by a feed device, wherein the fixing device is arranged at a transport apparatus, which is movable in a direction of feed along the pressed bale, and wherein the feed device feeds the upper part and the lower part with a feed motion aligned transversely to the direction of feed from the outside into the baling press, and the feed device is arranged at the transport apparatus and is carried along by same.

16. A process in accordance with claim 15, wherein the feeding of the upper part and the lower part of the bale wrapping takes place during or immediately after a discharge of a just previously packaged pressed bale from the baling press.

17. A process in accordance with claim 15, wherein the feed device is brought close to a feed position at the baling press during the application of the bale-fixing element and immediately after completion of a fixing process into the feed position and is moved in front of a freely accessible pressed bale.

18. A process in accordance with claim 15, wherein the feed motion of the upper part and the lower part and an unloading of the bale take place in a same direction and transversely to the direction of feed.

19. A process in accordance with claim 15, wherein:

the upper part and the lower part are fed into the baling press at press rams thereof, before pressing a pressed bale; and the upper part and the lower part are present as spread-out-flat, sheet and flexurally elastic enveloping elements and are kept ready at the feed device in an alignment ready for feeding a horizontally parallel alignment of principal planes thereof in relation to a principal plane of the respectively associated press ram.

20. A process in accordance with claim 15 wherein:

the multipart bale wrapping has a sheath side part;

the side part is applied at the pressed bale by means of a loading and unloading wrapping device; and the loading and unloading wrapping device is arranged at the transport apparatus.

* * * * *